US006080069A

United States Patent [19]

Long

[11] Patent Number: 6,080,069

[45] Date of Patent: Jun. 27, 2000

[54] GOLF CLUB HEAD WITH IMPROVED WEIGHT DISTRIBUTIONS

[75] Inventor: Dabbs Clayton Long, Carlsbad, Calif.

[73] Assignee: The Arnold Palmer Golf Company, Ooltewah, Tenn.

[21] Appl. No.: 09/007,952

[22] Filed: Jan. 16, 1998

[51] Int. Cl.[7] ..... A63B 53/04

[52] U.S. Cl. ..... 473/332; 473/349; 473/350

[58] Field of Search ..... 473/349, 350, 473/290, 291, 292, 333, 334, 335, 336, 337, 338, 339, 341, 324, 328, 332, 329

[56] References Cited

U.S. PATENT DOCUMENTS

| | | |
|---|---|---|
| D. 191,211 | 8/1961 | Forest . |
| D. 240,948 | 8/1976 | Redoutey . |
| D. 247,383 | 2/1978 | Adkins . |
| D. 247,918 | 5/1978 | Delano et al. . |
| D. 254,084 | 1/1980 | Hulyk . |
| D. 259,732 | 6/1981 | Vella . |
| D. 302,715 | 8/1989 | Petersen . |
| D. 316,584 | 4/1991 | Antonious . |
| 1,139,985 | 5/1915 | Legh . |
| 1,258,212 | 3/1918 | Goodrich . |
| 1,525,148 | 2/1925 | Pickop . |
| 1,652,404 | 12/1927 | Graveure . |
| 1,671,956 | 5/1928 | Sime . |
| 1,917,774 | 7/1933 | Ogg et al. . |
| 1,993,928 | 3/1935 | Glover . |
| 2,608,409 | 8/1952 | Pinkerton . |
| 2,686,056 | 8/1954 | Oquist . |
| 3,037,770 | 6/1962 | Palmer . |
| 3,059,926 | 10/1962 | Johnstone . |
| 3,064,980 | 11/1962 | Steiner . |
| 3,343,839 | 9/1967 | Borah . |
| 3,419,275 | 12/1968 | Winkleman . |
| 3,429,576 | 2/1969 | Ikeda . |
| 3,497,220 | 2/1970 | Scott . |
| 3,595,577 | 7/1971 | Hodge . |
| 3,625,513 | 12/1971 | Ballmer . |
| 3,814,437 | 6/1974 | Winquist . |
| 3,841,641 | 10/1974 | Bennett . |
| 3,845,955 | 11/1974 | Solheim . |
| 3,937,474 | 2/1976 | Jepson et al. . |
| 3,941,390 | 3/1976 | Hussey . |
| 3,955,820 | 5/1976 | Cochran et al. . |
| 3,966,210 | 6/1976 | Rozmus . |
| 3,995,857 | 12/1976 | Cochran et al. . |

(List continued on next page.)

FOREIGN PATENT DOCUMENTS

| | | |
|---|---|---|
| 558183 | 1/1975 | Switzerland . |
| 29603 | 12/1913 | United Kingdom . |
| 29603 | 8/1914 | United Kingdom . |
| 359487 | 10/1931 | United Kingdom . |
| 1078412 | 8/1967 | United Kingdom . |
| 1232651 | 5/1971 | United Kingdom . |
| 1297239 | 11/1972 | United Kingdom . |
| 2133295A | 7/1984 | United Kingdom . |
| 2170719A | 12/1985 | United Kingdom . |

OTHER PUBLICATIONS

1996 Cobra Golf, King Cobra II Advertisement.

1997 Mammoth Golf Full Line Catalog, p. 12 showing Snake Plus clubs.

1997 National Golf Suppliers Catalog, pp. 2,3,8,9, and 12—various hosel –weighted clubs.

1997 Photos of Palmer Standard Plus II golf clubs.

*Primary Examiner*—Sebastiano Passaniti
*Attorney, Agent, or Firm*—Miller & Martin LLP

[57] ABSTRACT

A golf club head having improved weight distributions to enhance important moments of inertia of the club head. A hollowed out toe rim cavity is provided in the toe portion of the periphery of the club head which is filled with a lightweight compressible material. The toe rim cavity and insert combination relocates the center of gravity of the club toward the heel, making the club easier to close at impact. The toe rim cavity and insert also redistribute mass on the toe portion of the club, increasing the moment of inertia about the horizontal axis of the club head. The insert also attenuates the vibrations generated at impact between the club head and a golf ball.

22 Claims, 2 Drawing Sheets

U.S. PATENT DOCUMENTS 3,995,865 12/1976 Cochran et al. .
4,214,754 7/1980 Zebelean .
4,220,336 9/1980 Kochevar .
4,265,451 5/1981 Bernhardt .
4,265,452 5/1981 Vella .
4,523,297 6/1985 Igarashi .
4,580,784 4/1986 Brill .
4,607,846 8/1986 Perkins .
4,621,813 11/1986 Solheim .
4,650,191 3/1987 Mills .
4,747,599 5/1988 Antonious .
4,754,997 7/1988 Sahm .
4,826,172 5/1989 Antonious .
4,834,387 5/1989 Waites et al. .
4,852,879 8/1989 Collins .
4,867,458 9/1989 Sumikawa et al. .
4,915,386 4/1990 Antonious .
4,938,470 7/1990 Antonious .
4,941,666 7/1990 Suganuma .
4,948,140 8/1990 Antonious .
4,999,000 3/1991 Finney .
5,004,237 4/1991 Antonious .
5,011,151 4/1991 Antonious .
5,046,733 9/1991 Antonious .
5,074,563 12/1991 Gorman .
5,078,400 1/1992 Desbiolles et al. .
5,118,562 6/1992 Johnson et al. .
5,165,688 11/1992 Schmidt et al. .
5,193,805 3/1993 Solheim .
5,193,811 3/1993 Okumoto et al. .
5,277,423 1/1994 Artus .
5,290,036 3/1994 Fenton et al. .
5,333,871 8/1994 Wishon .
5,335,914 8/1994 Long .
5,409,229 4/1995 Schmidt et al. .
5,417,419 5/1995 Anderson et al. .
5,419,560 5/1995 Bamber .
5,425,535 6/1995 Gee .
5,492,327 2/1996 Biafore, Jr. .
5,509,659 4/1996 Igarashi .
5,509,660 4/1996 Elmer .
5,516,107 5/1996 Okumoto et al. .
5,518,243 5/1996 Redman .
5,540,436 7/1996 Boone .
5,549,297 8/1996 Mahaffey .
5,558,332 9/1996 Cook .
5,564,705 10/1996 Kobayashi et al. .
5,570,886 11/1996 Rigal et al. .
5,586,947 12/1996 Hutin .
5,588,923 12/1996 Schmidt et al. .
5,595,548 1/1997 Beck .
5,601,501 2/1997 Kobayashi .
5,616,088 4/1997 Aizawa et al. .
B1 3,966,210 10/1991 Rozmus .

GOLF CLUB HEAD WITH IMPROVED WEIGHT DISTRIBUTIONS

BACKGROUND OF THE INVENTION

The present invention generally relates to golf clubs and more particularly to a golf club head having improved weight distributions which increase important moments of inertia of the club head, said club head also having a vibration dampening insert which attenuates vibrations generated at impact between the club head and a golf ball.

Club heads employing various types of perimeter weighting have become quite common in the art, especially iron club heads or "irons" having so-called "cavity back" designs. In these club heads, weight is in effect removed from the center of the club head and redistributed along the bottom of the club head, for example, or along the heel and toe portions of the club head, or around the entire periphery of the club head to produce a club head having a recess or cavity in the back. Club heads of the latter type have enjoyed considerable success since they effectively enlarge the "sweet spot" of the club head.

The "sweet spot" of the club head is generally regarded to be that area on the striking face of the club head immediately surrounding the center of gravity of the club head. By enlarging the sweet spot, perimeter weighted club heads allow golfers of all abilities to realize improved results over conventional club heads when the golfer fails to strike the golf ball in line with the center of gravity of the club head. These improved results translate into mis-hit shots that travel farther and straighter than they would if struck with a club having another conventional club head design.

U.S. Pat. No. 5,335,914 describes, in part, a golf club head having a weight member projecting outwardly from an angular segment of the periphery of the hosel which is less than 360°. As a result of the redistribution of weight on the hosel above the center of gravity, the moments of inertia of the club head about both the horizontal axis "x" and the vertical axis "y" extending through the center of gravity of the club head are advantageously increased. Increasing the moment of inertia about the horizontal axis stabilizes the club head at impact and increases energy transfer between the golf ball and the club face when the golf ball impacts the club face above or below the center of gravity of the club head. Increasing the moment of inertia about the vertical axis likewise stabilizes the club head at impact and increases energy transfer between the golf ball and the club face when the golf ball impacts the club face to the left or right of the center of gravity of the club head.

Simultaneously, the redistribution of the weight on the hosel closer to the axis of the shaft reduces the inertia through the shaft axis which helps the club "close" at impact more efficiently than if the weight were distributed in a more conventional manner. An "open" club at impact results in slices, one of the most common mis-hits, while a more "closed" club at impact is more advantageous in terms of hitting straighter shots or even hooking the ball.

SUMMARY OF THE INVENTION

The present invention relates to improving perimeter weighted golf club heads, and in particular, the above-discussed hosel-weighted golf club by providing a hollowed-out cavity in the toe portion of the periphery of the club head which is filled with a lighter weight, compressible rubber material. Hollowing the toe portion of the periphery of the club head relocates the center of gravity of the club head substantially toward the heel of the club, thus further reducing the moment of inertia about the shaft axis, making the club easier to close at impact, resulting in a club with which it is easier to hook or to move the ball from right to left.

Hollowing out a cavity in the toe portion of the club head also allows for the lengthening of the blade of the club and increasing the moment of inertia about the vertical axis "y" of the club head over existing club designs, without substantially increasing the moment of inertia through the shaft axis.

In a preferred embodiment of the invention, the hollowed-out cavity in the toe portion of the periphery of the club head is located such that a horizontal line passes through the center of gravity of the club head and the cavity when the club head is lying at address, i.e., when the sole of the club head is essentially lying flat on the ground. Filling the cavity with a lightweight material essentially creates two distinct upper and lower toe masses separated by the cavity further increasing the moment of inertia about the horizontal axis "x" over existing club designs.

Utilizing a hollowed-out cavity in the toe portion of the periphery of the club head in "oversized" club head designs, i.e., clubs having at least 3.1 inches of blade length, therefore, minimizes the detrimental effects of the elongation of such club heads.

Furthermore, filling the hollowed-out cavity with a rubber-like or elastic material insert has a vibration dampening effect. It is known that a golf club head joined to a shaft can transmit vibrational energy up the shaft to the player when the club head strikes a ball. These vibrations affect the strike of the ball and can be distracting to the player. In a preferred embodiment of the present invention, the rubber insert used to fill the toe rim cavity attenuates the vibrations generated at impact between the club head and a golf ball, thus giving the club a more "solid" feeling at impact.

Accordingly, it is an object of the present invention to relocate the center of gravity of the club head toward the heel of the club, thus reducing the moment of inertia through the shaft axis, making the club easier to close at impact, resulting in a club with which it is easier to hook or to move the ball from right to left.

It is a further object of the present invention to provide a golf club having a weight distribution which increases the moments of inertia about both horizontal and vertical axes through the club head center of gravity to more completely stabilize the club head at impact during mis-hit shots.

It is another object of the present invention to provide an "oversized" club head design which minimizes the detrimental effects of the elongation of the club heads. Those being previously described as toe lag, as well as club head "droop." "Droop" is a downward bending of the toe of the club due to the centrifugal force of the swing.

Another object of the present invention is to provide a golf club head which attenuates the vibrations generated at impact between the club head and a golf ball.

Another object of the present invention is to provide a light weight material to fill the toe cavity and prevent moisture and foreign debris from entering the cavity.

These and other objects, advantages and applications of the present invention will become apparent to those skilled in the art when the accompanying description of the preferred embodiment of the present invention is read in conjunction with the accompanying drawings.

DETAILED DESCRIPTION OF THE DRAWINGS

Figure 1:
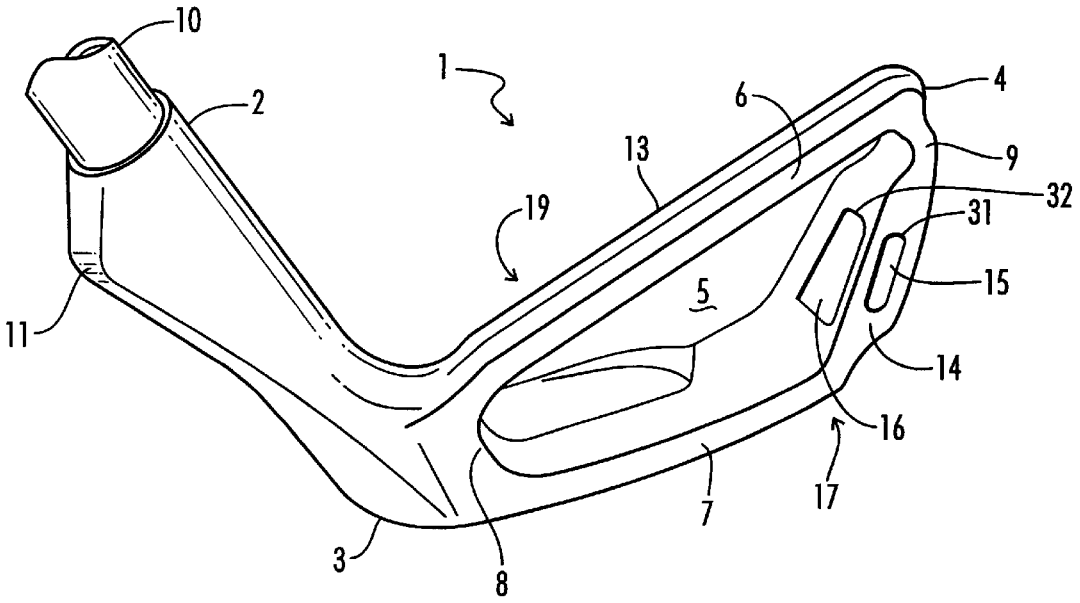
FIG. 1 is a rear perspective view of a perimeter weighted iron golf club head embodying the present invention.

Referring now to the drawings and in particular to FIG. 1, an "iron" type golf club head 1 includes a hosel 2, a heel 3, a toe 4, and a body 13 extending between the toe 4 and the heel 3. The body 13 has a rear 17 and a front striking face 19 (shown in FIG. 4). As shown in FIG. 1, the hosel 2 extends upwardly from the heel 3 to receive a golf club shaft 10. The preferred club head 1 is of the "perimeter weighted" variety in which a "cavity-back" 5 is created in the rear 17 of the body 13 of the club head 1, and is surrounded by a top rim 6, a bottom rim 7, a heel rim 8 and a toe rim 9. The preferred club head 1 also has an integrally formed hosel weight member 11 projecting outwardly from an angular segment of the periphery of the hosel 2, wherein the angular segment is less than 360°. Most preferably, the hosel weight member 11 projects away from and generally parallel to a lower leading edge 21 (shown in FIG. 4) of the club head 1.

Returning to FIG. 1, the toe rim 9 has a widened portion 14 which is hollowed-out above the bottom rim to define a toe rim cavity 15. The toe rim cavity 15 is filled with a material which has a lower density, i.e., is lighter weight, than the material from which the remaining portions of the golf club head 1 are formed. In a preferred embodiment of the invention, this material comprises an insert 16 formed from a lightweight, compressible rubber-like or elastic material such as urethane, rubber, silicone or another elastic polymer.

In one preferred embodiment, the toe rim cavity 15 has a rearward opening 31 and a side opening 32.

Figure 2:
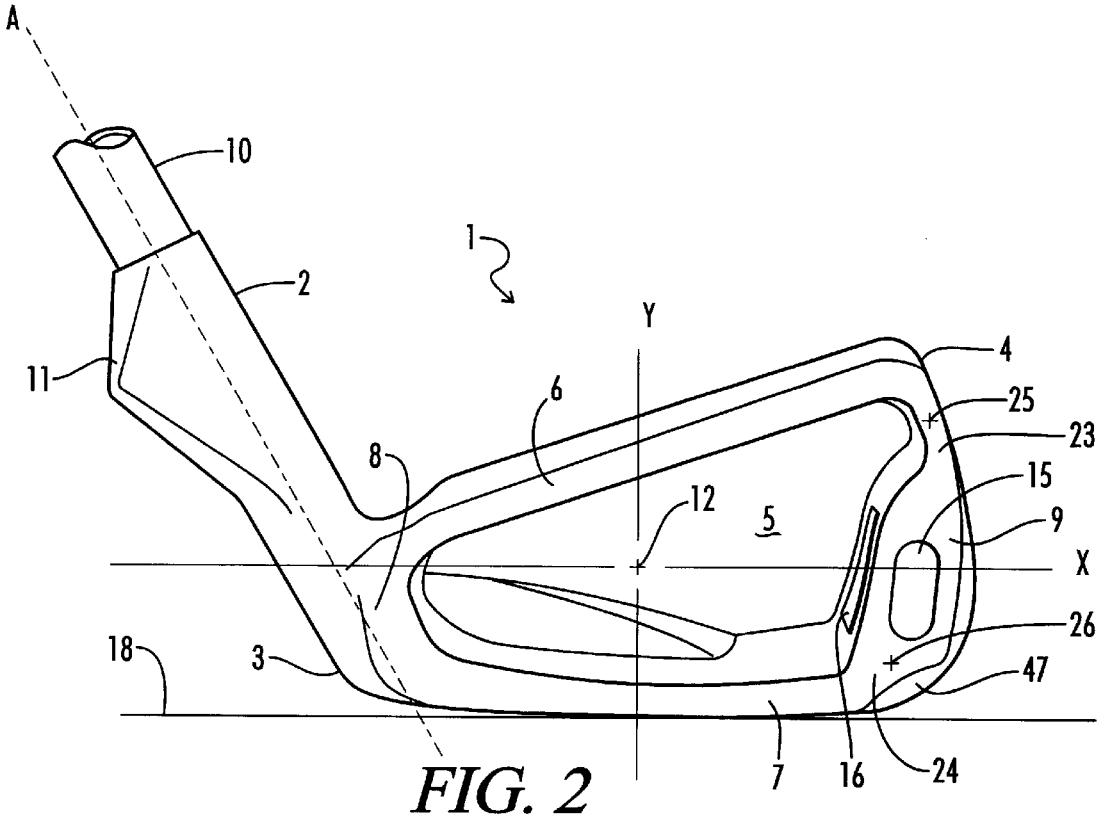
FIG. 2 is a rear view of the perimeter weighted iron of FIG. 1 shown at address resting on a support surface and showing the center of gravity of the club head and the preferred location of the toe rim cavity.

As shown in FIG. 2, the club head 1 has a center of gravity 12. The hollowing-out of the toe rim cavity 15 and the placement of a light weight insert 16 within the toe rim cavity 15 have the effect of relocating the center of gravity 12 of the club head 1 toward the heel 3 of the club 1. The insert 16 also serves to prevent dirt or other foreign materials from entering the toe rim cavity 15. In the preferred embodiment using an insert 16 formed from the preferred urethane material, the center of gravity 12 of the club head 1 is relocated 0.140 inches toward the heel 3 of the club 1. This relocation of the center of gravity 12 reduces the moment of inertia about the shaft axis "A" extending through the center of the shaft 10 by bringing the center of gravity 12 closer to the shaft axis "A". As described above, this makes the club head 1 easier to close at impact, resulting in a club with which it is easier to hook or to move the ball from right to left.

Hollowing out the toe rim cavity 15 also allows the mass formerly occupying the toe rim cavity 15 to be redistributed toward the heel 3 of the club head 1. This redistribution of mass also reduces the moment of inertia about the shaft axis "A" and also increases the moment of inertia about the vertical axis "y" extending through the center of gravity 12 of the club and generally perpendicular to the support surface 18, such as ground on which the club head 1 rests at address. Increasing the moment of inertia about the vertical axis "y" of the club head 1 stabilizes the club head at impact and increases energy transfer between the golf ball and the club face when the golf ball impacts the club face to the left or right of the center of gravity 12 of the club head 1.

In a preferred embodiment, a notch 47 positioned proximate to the juncture of the toe rim 9 and the bottom rim 7 is also employed to redistribute mass from the toe 4 of the club 1 toward the heel 3.

In the preferred embodiment of the invention shown in FIG. 2, the horizontal axis "x" extending through the center of gravity 12 of the club and generally parallel to the support surface 18 passes through the toe rim cavity 15 in the toe rim 9. Filling the toe rim cavity 15 with a lightweight rubber-like material insert 16 essentially creates two distinct upper and lower toe masses, 23 and 24 respectively, separated by the toe rim cavity 15. This represents a redistribution of the mass of the toe rim 9 above and below the horizontal axis "x" of the club head 1. The upper toe mass 23 has a center of mass 25 and the lower toe mass 24 has a center of mass 26. Moving these centers of mass 25, 26 further away from the horizontal axis "x" has the effect of creating weight members above and below the center of gravity 12 of the club head 1., thus increasing the moment of inertia about the horizontal axis "x" over existing club designs.

Figure 3:
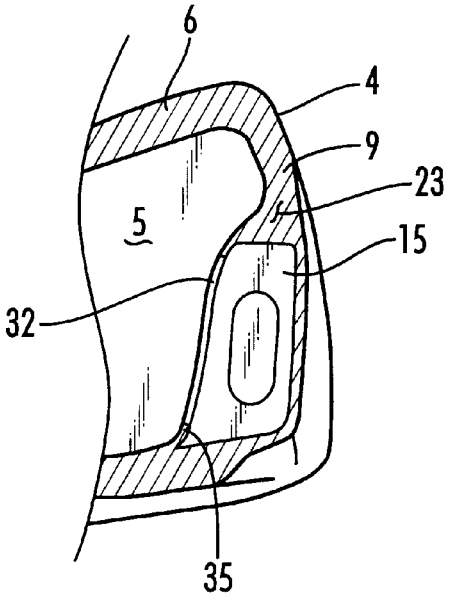
FIG. 3 is a cross sectional view of the preferred shape of the cavity in the toe rim of the golf club head of the present invention viewed in a plane generally parallel to the plane of the striking face of the club head.

As shown in FIG. 3, the toe rim cavity 15 preferably tapers in thickness such that its thickness in a plane generally parallel to the striking face 19 (shown in FIG. 4) of the club 1 decreases upwardly along the toe rim 9. As further shown in FIG. 4, the toe rim cavity 15 also tapers in thickness such that its thickness in a plane generally perpendicular to the striking face 19 of the club 1 decreases upwardly along the toe rim 9. This tapering of the toe rim cavity 15 towards the top rim 6 of the club 1 concentrates the effective redistribution of weight in the upper toe mass 23 so as to further increase the effectiveness of the hosel weight member 11 in still further increasing the moment of inertia of the club head about the horizontal axis "x".

Figure 4:
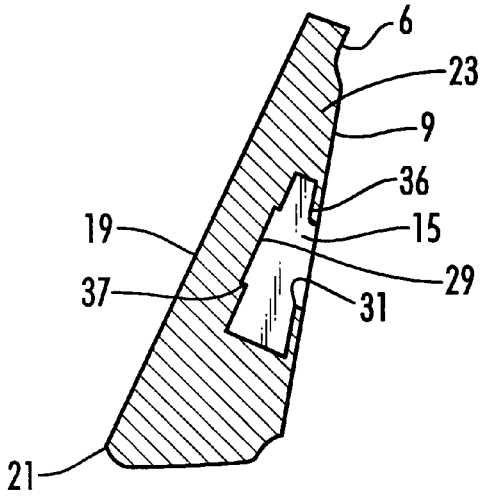
FIG. 4 is a cross sectional view of the shape of the cavity in the toe rim of the golf club head of the present invention viewed in a plane perpendicular to the striking face of the club head.
Figure 5:
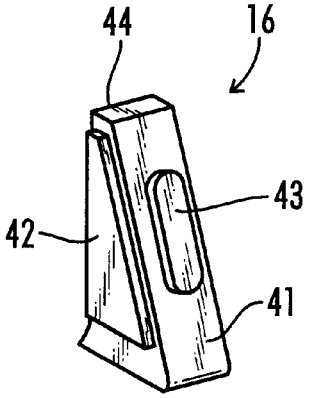
FIG. 5 is a perspective view of the cavity insert of the present invention.

As shown in FIG. 3, the toe rim cavity 15 widens substantially inward of the side opening 32, thereby creating a retaining edge 35 for a cooperating protruding member 42 on the insert 16 (shown in FIG. 5). As shown in FIG. 4, the toe rim cavity 15 widens substantially inward of the rearward opening 31 and also has rear indentation 29, creating additional retaining edges 36, 37 for cooperating protruding members 43, 44, respectively, on the insert 16 (shown in FIG. 5).

A preferred shape for the insert 16 of the present invention is shown in FIG. 5. The body 41 of the insert 16 is shaped to conform tightly to the toe rim cavity 15 and has protruding members 42, 43 and 44 shaped to fill the side opening 32, rearward opening 31, and rear indentation 29, respectively, of the toe rim cavity 15. The insert 16 is preferably formed from a compressible material such as rubber and is inserted into the toe rim cavity 15 of the club head 1 through an opening 31 or 32 after the club head 1 is cast or molded. The insert 15 is compressed as it is forced through an opening 31 or 32, but expands once inside the toe rim cavity 15 to substantially fill the toe rim cavity 15. The cooperation of retaining edges 35, 36 and 37 and protruding members 42, 43 and 44, respectively, secure the insert 16 within the toe rim cavity 15. For ease of manufacturing, it is preferable that the toe rim cavity 15 of each club head 1 in a set of irons be of an identical size and shape so that one size of insert 16 may be used for all club heads 1. Alternatively, however, the size and shape of the toe rim cavity 15 could be varied between differently lofted clubs in a set to optimize the advantages of the present invention.

When formed from the preferred compressible light-weight material, the insert 16 attenuates vibrations generated at impact between the club head and a golf ball, thus giving the club a more "solid" feel at impact.

While several embodiments of the present invention have been disclosed, it is to be understood by those skilled in the art that other forms can be adopted, all coming within the spirit of the invention and scope of the appended claims:

I claim:

1. A metal golf club head having a toe, a heel, a body extending between said toe and said heel, said body having a front striking face and a rear, a cavity-back in the rear of the body surrounded by a top rim, a bottom rim, a heel rim, and a toe rim, a hosel extending upwardly from said heel for receiving a golf club shaft, and a hollow toe rim cavity in the toe rim, said toe rim cavity positioned above the bottom rim and containing an insert of material which has a lower density than the metal.

2. A golf club head according to claim 1 wherein said club head includes a center of gravity located between said toe and said heel, and wherein a horizontal line containing the center of gravity and generally parallel to a lower leading edge of said club head passes through said toe rim cavity.

3. A golf club head according to claim 2 wherein the toe rim cavity tapers in thickness such that its thickness in a plane generally parallel to the striking face of the club decreases upwardly along the toe rim.

4. A golf club head according to claim 2 wherein the toe rim cavity tapers in thickness such that its thickness in a plane generally perpendicular to the striking face of the club decreases upwardly along the toe rim.

5. A golf club head according to claim 1 wherein said insert material is an elastic material selected from the group consisting of rubber, urethane or silicone.

6. A golf club head according to claim 1 further comprising a weight member projecting outwardly from an angular segment of the periphery of said hosel, wherein said angular segment is less than 360°.

7. A golf club head according to claim 1 wherein the toe rim cavity further comprises at least one opening forming a retaining edge in the toe rim cavity and the insert further comprises at least one protruding member which cooperates with the retaining edge to secure the insert within the toe rim cavity.

8. A golf club head according to claim 7 wherein said opening further comprises a rearward opening and a side opening.

9. A golf club head according to claim 1 further comprising a notch positioned proximate to the juncture of the toe rim and the bottom rim.

10. A metal golf club head having a toe, a heel, a body extending between said toe and said heel, said body having a front striking face and a rear, a cavity-back in the rear of the body surrounded by a top rim, a bottom rim, a heel rim, and a toe rim, a hosel extending upwardly from said heel for receiving a golf club shaft, a weight member projecting outwardly from an angular segment of the periphery of said hosel, wherein said angular segment is less than 360°, and a hollow toe rim cavity in the toe rim, said toe rim cavity positioned above the bottom rim and containing an insert of material which has a lower density than the metal.

11. A golf club head according to claim 10 wherein said club head includes a center of gravity located between said toe and said heel, and wherein a horizontal line containing the center of gravity and generally parallel to a lower leading edge of said club head passes through said toe rim cavity.

12. A golf club head according to claim 11 wherein the toe rim cavity tapers in thickness such that its thickness in a plane generally parallel to the striking face of the club decreases upwardly along the toe rim.

13. A golf club head according to claim 11 wherein the toe rim cavity tapers in thickness such that its thickness in a plane generally perpendicular to the striking face of the club decreases upwardly along the toe rim.

14. A golf club head according to claim 10 wherein said insert material is an elastic material selected from the group consisting of rubber, urethane or silicone.

15. A golf club head according to claim 10 wherein the toe rim cavity further comprises at least one opening forming a retaining edge in the toe rim cavity and the insert further comprises at least one protruding member which cooperates with the retaining edge to secure the insert within the toe rim cavity.

16. A golf club head according to claim 15 wherein said opening further comprises a rearward opening and a side opening.

17. A golf club head according to claim 10 further comprising a notch positioned proximate to the juncture of the toe rim and the bottom rim.

18. A metal golf club head having a toe, a heel, a body extending between said toe and said heel, said body having a front striking face, a lower leading edge, and a rear, and including a center of gravity, a cavity-back in the rear of the body surrounded by a top rim, a bottom rim, a heel rim, and a toe rim, a hosel extending upwardly from said heel for receiving a golf club shaft, a weight member projecting outwardly from an angular segment of the periphery of said hosel, wherein said angular segment is less than 360°, a hollow toe rim cavity in the toe rim, said toe rim cavity positioned above the bottom rim and further positioned such that a horizontal line containing the center of gravity and generally parallel to the lower leading edge passes through said cavity, said toe rim cavity tapering in thickness such that its thickness in a plane generally parallel to the striking face of the club decreases upwardly along the toe rim, said toe rim cavity further tapering in thickness such that its thickness in a plane generally perpendicular to the striking face of the club decreases upwardly along the toe rim, and an insert of material which has a lower density than the metal contained within said cavity.

19. A golf club head according to claim 18 wherein said insert material is an elastic material selected from the group consisting of rubber, urethane or silicone.

20. A golf club head according to claim 18 wherein the toe rim cavity further comprises at least one opening forming a retaining edge in the cavity and the insert further comprises at least one protruding member which cooperates with the retaining edge to secure the insert within the toe rim cavity.

21. A golf club head according to claim 20 wherein said opening further comprises a rearward opening and a side opening.

22. A golf club head according to claim 18 further comprising a notch positioned proximate to the juncture of the toe rim and the bottom rim.

* * * * *